United States Patent [19]

Duval et al.

[11] Patent Number: 4,595,124

[45] Date of Patent: Jun. 17, 1986

[54] SEMI-SOLID CYLINDRICAL CONTAINER AND DISPENSER

[75] Inventors: Ernest H. Duval, Winthrop; Louis V. Nigro, Saugus, both of Mass.

[73] Assignee: The Gillette Company, Boston, Mass.

[21] Appl. No.: 717,962

[22] Filed: Mar. 29, 1985

[51] Int. Cl.[4] ..... B67D 5/32

[52] U.S. Cl. ..... 222/39; 222/390; 401/174; 401/194

[58] Field of Search ..... 222/39, 319, 390, 386; 446/415, 417; 401/171, 172, 174, 194

[56] References Cited

U.S. PATENT DOCUMENTS

| | | | |
|---|---|---|---|
| 527,516 | 10/1894 | van Guysling | 184/37 |
| 835,606 | 11/1906 | Frimand | 222/390 |
| 978,189 | 12/1910 | Moss | 401/84 |
| 1,071,754 | 9/1913 | Kennedy | 184/45 R |
| 1,472,123 | 10/1923 | Heinitsh et al. | 222/320 |
| 1,527,257 | 2/1925 | Kirschen | 401/47 |
| 1,950,324 | 3/1934 | Powers | 401/194 |
| 2,085,446 | 6/1937 | Phillipe | 222/386 |
| 2,272,641 | 2/1942 | Mureau | 222/390 X |
| 2,284,218 | 5/1942 | Livingston | 401/194 X |
| 2,287,321 | 6/1942 | Mureau | 401/174 |
| 2,617,522 | 11/1952 | Coe | 401/59 |
| 2,816,309 | 12/1957 | Worth et al. | 401/175 |
| 2,917,765 | 12/1959 | Jakubowski | 401/175 |
| 3,175,680 | 3/1965 | Fuglsang-Madsen et al. | 401/194 |
| 3,826,580 | 7/1974 | Bohli | 401/132 |
| 3,873,008 | 3/1975 | Jahn | 222/390 |
| 3,993,226 | 11/1976 | Pavenick | 222/327 |
| 4,013,370 | 3/1977 | Gingras | 401/175 |
| 4,232,977 | 11/1980 | Chutter | 401/68 |
| 4,445,626 | 5/1984 | Steffen et al. | 222/39 |
| 4,479,781 | 10/1984 | Herold et al. | 222/390 |
| 4,521,127 | 6/1985 | Tomburo et al. | 401/171 |

FOREIGN PATENT DOCUMENTS

| | | | |
|---|---|---|---|
| 811930 | 4/1951 | Fed. Rep. of Germany | 401/174 |

OTHER PUBLICATIONS

Calumet Manufacturing Co., Inc., Product Line Brochure, 1-79.

*Primary Examiner*—Joseph J. Rolla
*Assistant Examiner*—P. McCoy Smith
*Attorney, Agent, or Firm*—Scott R. Foster

[57] ABSTRACT

The present disclosure is directed to a container for dispensing semi-solid products consisting of a cylindrical body having a rounded closed applicator end and an opposite open ended base. A dome shaped product discharge piston is movable through the body beneath the storage chamber driven by a piston drive screw having two flat and two arcuate sides opposed each other for driving the piston upwardly in the cylindrical body to discharge the product. A dial and screw drive ratchet is positioned within said container and has a manually rotatable apron for advancing the screw shaft and piston and is positioned beneath said piston. A base and wrench is positioned at the open end of the container for positioning and supporting the dial and screw drive ratchet to permit the drive screw to be rotated by the dial apron while permitting axial motion of the drive screw through the base and wrench to drive the piston upwardly. A vertical wall having circumferentially spaced vertically disposed ribs exteriorly thereof is carried by the base and wrench and forms an element of the metering device for regulating the amount of contents to be discharged by upward motion of the piston. A pawl clicker is carried by the dial apron and is positioned to strike the vertical ribs on the vertical wall to cause an audible click and signal discharge of a metered amount of contents.

6 Claims, 6 Drawing Figures

SEMI-SOLID CYLINDRICAL CONTAINER AND DISPENSER

TECHNICAL FIELD

The present disclosure is directed to an apparatus for product containment and metered quantity dispensing of semi-solid products wherein a cylindrical container is provided with a product compartment the bottom of which is a screw drive piston elevatable to dispense metered quantities of the product and the apparatus is provided with an audible click signal indicating the amount of piston displacement that has taken place upon manual rotation of a screw elevating device positioned to drive the piston upwardly to dispense a desired metered quantity of the semi-solid product. By way of example, two clicks upon manual rotation of the screw elevating device would dispense the proper quantity for underarm deodorant application without leaving a messy feeling.

BACKGROUND ART

While applicant has listed a number of prior art patents cited by applicant as relevant to this invention, the following are the only patents known by applicant at the time of filing this application and believed to be pertinent to the claims hereof:

W. E. Powers U.S. Pat. No. 1,950,324

H. Worth et al U.S. Pat. No. 2,816,309

T. P. Jakubowski U.S. Pat. No. 2,917,765

Calumet Brochure U.S. 5M 1-79

While teaching piston expulsion of semi-solid contents from a cylindrical container the above patents do not employ the specifically claimed structural elements, their operating interrelationships in combination with the claimed form of an audible signaling metering means.

DISCLOSURE OF THE INVENTION

In accordance with my invention I provide a semi-solid product dispenser container of the cylindrical type having an applicator end and a bottom or filling end. A piston beneath the contents to be discharged through openings in the applicator end urges the product upwardly by being forced upwardly by a screw driven by a hand rotated dial carried by the container. The screw is driven by a threaded boss connected to a rotary dial to be manually manipulated. The screw has two flats to restrain it from rotary movement while permitting it to move axially under the drive of the dial which elevates the screw. The screw moves upwardly through a base and anchor means which acts on the flats of the screw restraining it from rotation but permitting it to raise the piston and cause extrusion of the container contents through the applicator openings.

The amount of discharge of the contents of the container is audibly signaled by a clicker mechanism formed by a hollow vertically ribbed wall carried by the base wrench means and a pawl carried by the inside of the rotary dial positioned to audibly click over the vertically ribbed wall, two clicks being a normal application to, by way of example, an under arm area. The pawl also restrains rotation of the dial in the reverse direction.

An elongated cover passes over the applicator end and is screw fit to the base area of the container for both sanitary and aesthetic reasons.

THE BEST MODE FOR CARRYING OUT THE INVENTION

Figure 6:
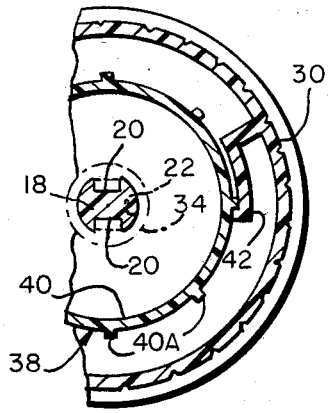
FIG. 6 is a fragmentary horizontal sectional view of the dispensing metering unit taken on the line 6—6 in FIG. 4.
Figure 4:
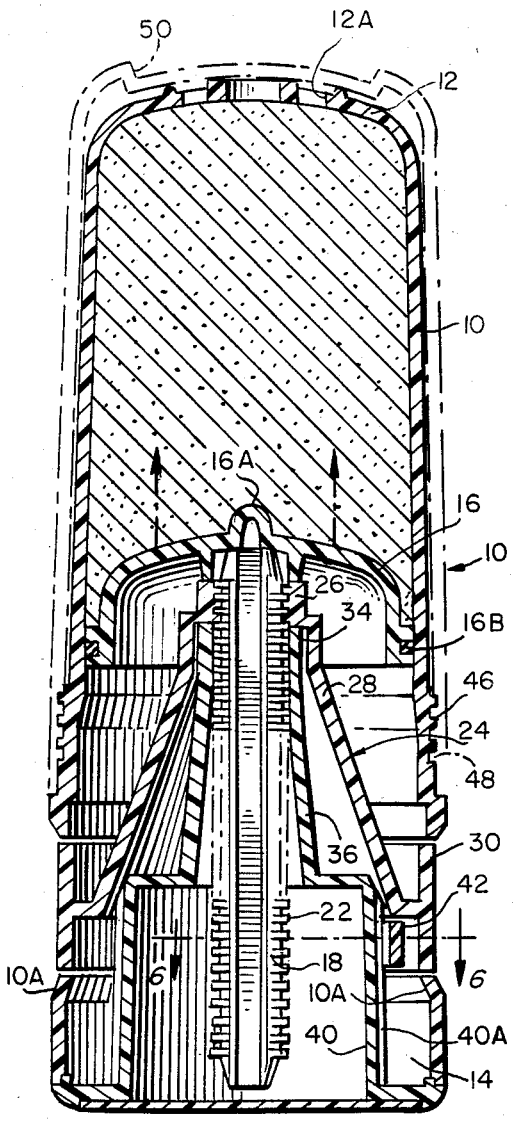
FIG. 4 is a vertical sectional view of the container and cap of FIG. 1 with the container full of a semi-solid taken on the line 4—4 of FIG. 3.
Figure 5:
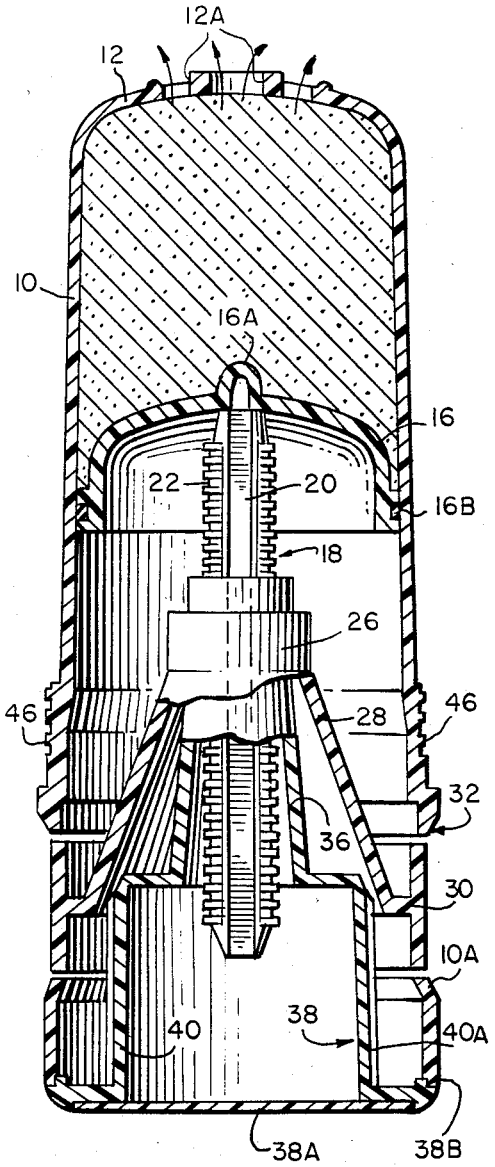
FIG. 5 is a vertical sectional view similar to FIG. 4 with the cap removed and the contents of the container partially expelled therefrom.

Referring now to FIGS. 4 and 5, 10 designates a cylindrical container of plastic, preferably polypropylene having a rounded closed applicator end 12 and an open bottom 14. The closed end has discharge or extrusion openings 12A through which the semi-solid contents of the container are discharged by the upward motion of the dome shaped piston 16 driven by a drive screw 18 having flat sides 20 and threaded sides 22, best seen in FIG. 6.

Figure 1:
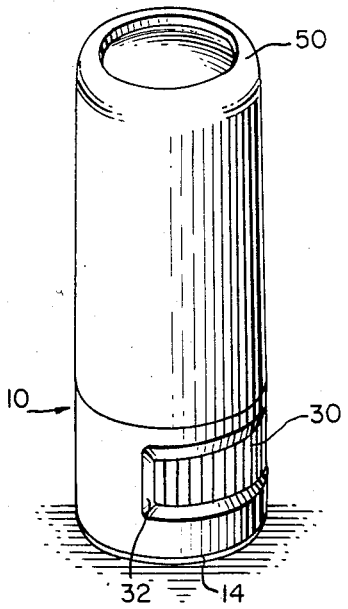
FIG. 1 is a perspective view of the combined semi-solid dispensing container and cap constructed in accordance with the present invention.
Figure 2:
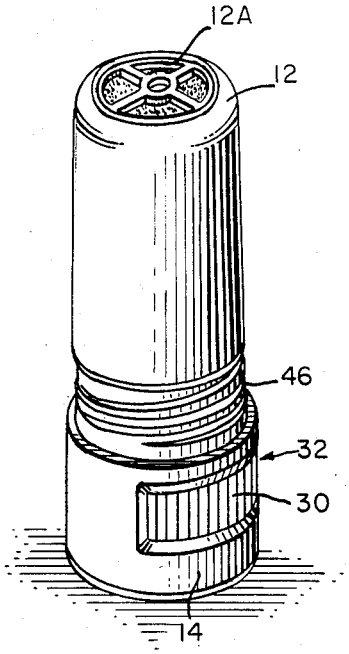
FIG. 2 is a perspective view of the dispensing container of FIG. 1 with the cap removed.
Figure 3:
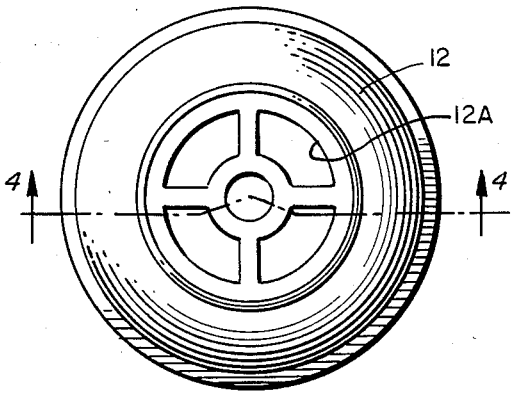
FIG. 3 is a top plan view of FIG. 2.

The screw 18 is driven by the dial and screw drive ratchet means 24 having a threaded boss 26 mounted on a frusto-conical support 28 having an annular base operating apron 30 accessible through windows 32 in the container wall, see FIGS. 1 and 2.

The threaded boss 26 carrying the drive screw 18 rests upon a non-threaded boss 34 on a frusto-conical support 36 of the base and wrench means 38. At the base of the frusto-conical support 36 a vertical wall 40 extends to the base of the base and wrench means 38. The vertical wall 40 has circumferentially spaced vertically disposed ribs 40A exteriorly thereof which are engaged by a pawl 42 extending off the inside of the apron or dial 30, see FIG. 6, to form an audible metering drive for the displacement piston 16.

The non-threaded boss 34 on the base and wrench means 38 having the two flat sides 20 permits the screw 18 to pass axially through the boss 34 while being driven by the threaded boss 26 driven by the operating apron 30 which causes the piston 16 to expel semi-solid contents through the closed end extrusion openings 12A.

The container 10 has threads 46 complemental to the internal threads 48 of cover 50 for retaining the elongated cover 50 securely upon the container 10 as shown in FIGS. 1 and 4.

The piston 16 is provided with an annular sealing or gasket ring 16B which bears against the inner walls of the container 10 to contain the contents so that there will not be leakage below the piston 16 as shown in FIGS. 4 and 5. The top of the container 10 is sealed by the cover 50 so that the contents of the container will be securely trapped between the cover 50 and the piston gasket 16B.

The bottom of the base and wrench means 38 is covered by a disc 38A which, with the vertical wall 40, forms a sound chamber to amplify the audible click of the pawl 42 passing over the vertical ribs 40A upon rotation of the apron 30. This disc 38A also acts as a dust shield for the dispensing working mechanism.

FILLING THE PRODUCT INTO THE CONTAINER

It has been found to be desirable to fill the product holding portion of the container 10 without the usual headspace. This is necessary because of the possibility of the semi-solid product shifting position during shipment which could result in uncontrolled extrusion of the product due to air pockets created by movement of the headspace. It was decided to fill the product from the bottom. After filling the container 10 the dial and screw drive ratchet means 24 and drive screw 18 are preassembled and inserted into the container base. The outer portion of the diameter is interfered from free movement into position by two shelves 10A which extend into the container 10.

When force is applied to the dial or apron 30, distortion of the dial and body allow the assembly to move past the obstructing shelf 10A which snaps into place and retains the dial 30 when properly positioned.

This keeps the dial 30 from moving axially of the cylinder but free to be revolved or twisted by finger action applied through the two windows 32 in the side walls of the body 10, shown in FIGS. 1 and 2.

The drive action is finally accomplished when the base wrench means 38 is positioned to restrain the screw 18 from revolving.

Clicks are made audible through the use of the ratchet and pawl 42 arrangement. This further restrains the dial 30 from movement in the wrong direction.

An alternate assembly means would eliminate the obstruction of the free insertion of the dial 30 but replace it with a shelf arrangement provided by fastening the base to the body securely to eliminate not only radial twisting, but the downward thrust of the dial as the system is activated to extrude product. This is being accomplished through un ultrasonic weld 38B of the base 38 to the body 10.

PRODUCT EXTRUSION AND USE BY CONSUMER

Containers commercially sold extrude and apply a semi-solid product utilize a piston drive arrangement with multiple small diameter holes in the top applicator surface. When the dial at the bottom was twisted, the product was extruded through the holes and deposited like soft spaghetti on the surface, cited as BACKGROUND ART hereinbefore.

My product is extruded by means of the three elements (1) a screw 18, (2) a dial 30 with a threaded portion to engage the treads of the screw, and (3) a base with a wrench holding means 38 which engages two flats on the screw to restrain it from rotary movement while being free to move vertically axially of the container.

In prior art devices when the applicator end 12 is placed against the skin, the product is mushed against the dispenser head and as the dispenser is slid across the skin surface a glob of product is left as the dispenser head tends to wipe itself dry. On subsequent passes, the glob of product tends to be scraped off of the skin surface, and become attached to the sides of the dispensing surfaces applicator.

This leads to a messy, unslightly, non-hygienic mess. This condition is accentuated when the cap is placed on the container and the product is now transferred to the inner side walls of the cap. My design provides a clean applicator surface and cap.

In actual use tests I was unable to communicate to the user how much to elevate the product so that a measured amount of product was available for use. I found excess use of the product and a resultant drop in the product's aesthetic properties. Excess product application equates to a greasy feeling.

I incorporated the audible metering means to communicate to the consumer the preferred application amount. This was accomplished through use of the dial 30 extrusion activator with a built in clicker which provided audible clues as to the amount being dispensed. (Two clicks recommended per axialla).

The parts, container 10, cover 10A, drive screw 18, dial and screw drive ratchet means 24 and the base and wrench means 38 may be injection molded of polypropylene plastic.

Referring to FIG. 5, there is a small projection 16A upstanding from the center of the upper surface of the piston 16. This projection is in alignment with the central extrusion opening 12A. When the semi-solid contents are almost exhausted, the projection 16A enters the central orifice 12A and is a visual signal to the user, who then knows he has only a limited number (typically four) of applications left. The projection 16A is presently colored blue so that it is readily apparent in contrast to the beige colored container 10.

What we claim is:

1. A container for dispensing semi-solid products comprising:

a first cylindrical body having a rounded closed applicator end and an opposite open ended base, said body having product discharge openings through said rounded closed end, the major portion of said body forming a product storage chamber for a viscous semi-solid product to be dispensed, a dome shaped product discharge piston movable through said body beneath said storage chamber, a piston drive screw having two flat and two arcuate sides opposed each other for driving said piston upwardly in said cylindrical body to discharge the product to be dispensed through said product discharge openings, dial and screw drive ratchet means positioned within said container having a manually rotatable cylindrical apron for advancing the screw shaft and piston positioned beneath said piston, a base and wrench means positioned at the open end of said container positioning and supporting said dial and screw drive ratchet means to permit the drive screw to be rotated by the dial apron on said dial and screw drive ratchet means while permitting axial motion of said drive screw through said base and wrench means to drive the piston upwardly, said base and wrench means carrying a cylindrical wall defining a sound chamber having vertically disposed ribs exteriorly thereof, and metering means for regulating the amount of contents to be discharged by upward motion of said piston comprising a pawl clicker carried by the dial apron on said dial and screw ratchet means positioned to strike the vertical ribs on the wall defining said sound chamber means on said base and wrench means to cause an audible click to sound on passage of the pawl over a rib while advancing the drive screw to move the piston upwardly and signal discharge of a metered quantity of the semi-solid contents through the discharge openings in the rounded closed end of the container.

2. A container as claimed in claim 1 further comprising an elongated cover for said rounded closed end extending over a major portion of said cylindrical body and being screw fitted therewith.

3. A container as claimed in claim 1 wherein said container has diametrically opposed arcuate open slots in the first cylindrical body positioned to register with said manually rotatable cylindrical apron for advancing said apron to expel the product through the discharge openings in said rounded applicator end.

4. A container as claimed in claim 1 wherein the wall defining said sound chamber means is a vertical wall substantially concentric with the outer wall of said cylindrical container and said manually rotatable cylindrical apron of said dial and screw drive ratchet means.

5. A container as claimed in claim 3 wherein resilient beveled shelves define the bottom walls of said arcuate slots forming ledge supports for the dial and screw drive ratchet means.

6. A container as claimed in claim 1 wherein said dome-shaped product discharge piston contains at the apex of said dome a signal projection positioned to pass through a product discharge opening through said rounded closed end to indicate a limited quantity of contents remaining in said product storage chamber.

* * * * *